US011261829B2

(12) United States Patent
Brand et al.

(10) Patent No.: US 11,261,829 B2
(45) Date of Patent: Mar. 1, 2022

(54) METHOD FOR CONTROLLING A CONTROL VALVE

(71) Applicant: VOLKSWAGEN AKTIENGESELLSCHAFT, Wolfsburg (DE)

(72) Inventors: Michael Brand, Wolfsburg (DE); Silke Weddig, Braunschweig (DE); Björn Fröhlich, Gifhorn (DE); Jens Wodausch, Braunschweig (DE); Christian Arenz, Braunschweig (DE)

(73) Assignee: VOLKSWAGEN AKTIENGESELLSCHAFT, Wolfsburg (DE)

( * ) Notice: Subject to any disclaimer, the term of this patent is extended or adjusted under 35 U.S.C. 154(b) by 0 days.

(21) Appl. No.: 16/423,458

(22) Filed: May 28, 2019

(65) Prior Publication Data

US 2019/0360435 A1 Nov. 28, 2019

(30) Foreign Application Priority Data

May 28, 2018 (DE) ..... 10 2018 112 731.6

(51) Int. Cl.
*F02M 25/08* (2006.01)
*F02D 41/00* (2006.01)

(52) U.S. Cl.
CPC ..... *F02M 25/0836* (2013.01); *F02D 41/004* (2013.01); *F02D 41/0042* (2013.01); *F02D 41/0045* (2013.01); *F02M 25/089* (2013.01); *F02D 2200/0602* (2013.01); *F02D 2200/0606* (2013.01)

(58) Field of Classification Search
CPC ..... F02D 2200/0602; F02D 2200/0606; F02D 41/004; F02D 41/0042; F02D 41/0045; F02M 25/08; F02M 25/0836; F02M 25/089
USPC ..... 123/520
See application file for complete search history.

(56) References Cited

U.S. PATENT DOCUMENTS 5,072,712 A * 12/1991 Steinbrenner ..... F02D 41/0032 123/520
5,188,085 A * 2/1993 Habaguchi ..... F02D 41/0045 123/520
5,249,561 A * 10/1993 Thompson ..... F02D 41/0032 123/494

(Continued)

FOREIGN PATENT DOCUMENTS

CN 102621212 A 8/2012
CN 105298690 A 2/2016

(Continued)

OTHER PUBLICATIONS

Office Action and Search Report for Chinese Patent Application No. 201910445689.1, dated Aug. 11, 2021.

*Primary Examiner* — John M Zaleskas
(74) *Attorney, Agent, or Firm* — Pearl Cohen Zedek Latzer Baratz LLP

(57) ABSTRACT

A method for controlling a control valve, the control valve controlling a volume flow of a fluid along a line, the method including at least the following steps: (a) performing a closing operation of the control valve; (b) measuring a pressure profile upstream of the control valve; and (c) determining a density of the fluid.

10 Claims, 2 Drawing Sheets

(56) References Cited

U.S. PATENT DOCUMENTS 5,363,832 A * 11/1994 Suzumura ..... F02D 41/0045 123/478
5,575,265 A * 11/1996 Kurihara ..... F02M 25/0809 123/520
5,746,187 A * 5/1998 Ninomiya ..... F02D 41/0032 123/520
2002/0170550 A1* 11/2002 Mitsutani ..... F02D 41/0042 123/674
2002/0179066 A1 12/2002 Matsumoto et al.
2004/0200460 A1 10/2004 Mitani et al.
2005/0211228 A1* 9/2005 Amano ..... F02M 25/0809 123/520
2006/0031000 A1* 2/2006 Amano ..... F02D 41/0045 701/114
2006/0144373 A1* 7/2006 Kano ..... F02D 41/0045 123/519
2006/0225713 A1* 10/2006 Kano ..... F02D 41/0032 123/520
2007/0062495 A1 3/2007 Kano et al.
2007/0089721 A1* 4/2007 Amano ..... F02D 41/0045 123/698
2007/0137622 A1* 6/2007 Koyama ..... F02M 25/0809 123/520
2007/0157907 A1* 7/2007 Takakura ..... F02D 41/0045 123/494
2007/0175455 A1* 8/2007 Amano ..... F01M 13/023 123/520
2007/0251509 A1* 11/2007 Nakano ..... F02D 41/0045 123/519
2007/0295313 A1* 12/2007 Amano ..... F02D 41/0032 123/520
2008/0141983 A1* 6/2008 Takakura ..... F02M 25/089 123/520
2008/0314369 A1* 12/2008 Takakura ..... F02M 25/0827 123/520
2009/0070001 A1* 3/2009 Takakura ..... F02D 41/0032 701/102
2009/0133673 A1* 5/2009 Amano ..... B60K 6/48 123/520
2012/0186564 A1 7/2012 Vigid et al.
2013/0213366 A1* 8/2013 Weigl ..... F02D 29/02 123/520
2016/0017849 A1 1/2016 Shirai
2016/0123254 A1* 5/2016 Burleigh ..... F02D 41/004 123/520
2017/0067409 A1 3/2017 Doelker
2017/0152813 A1 6/2017 Casetti et al.
2017/0159588 A1* 6/2017 Honjo ..... B01D 53/0446
2017/0218893 A1 8/2017 Duerrwaechter et al.
2018/0179983 A1 6/2018 Ritsch et al.
2018/0372030 A1* 12/2018 Achleitner ..... F02M 25/0836
2019/0101082 A1* 4/2019 Sanuma ..... F02M 25/0836
2019/0113007 A1* 4/2019 Kato ..... F02D 41/0045
2019/0145354 A1* 5/2019 Kato ..... F02M 25/08
2019/0178179 A1* 6/2019 Wodausch ..... F02D 41/0045
2019/0203666 A1* 7/2019 Asanuma ..... F02M 25/08
2019/0242331 A1* 8/2019 Kato ..... B60K 15/03504
2019/0271271 A1* 9/2019 Nakagawa ..... F02D 41/0032
2019/0285011 A1* 9/2019 Asanuma ..... F02M 25/08
2019/0301381 A1* 10/2019 Hatano ..... F02M 25/0836
2019/0301403 A1* 10/2019 Asanuma ..... F02M 25/0872
2019/0331036 A1* 10/2019 Asanuma ..... F02D 41/003
2019/0331064 A1* 10/2019 Asanuma ..... F02M 25/0809
2019/0353112 A1* 11/2019 Kim ..... F02D 41/0042
2019/0360408 A1* 11/2019 Wodausch ..... F02D 41/0042
2020/0025156 A1* 1/2020 Mizushima ..... F02M 25/0836
2020/0141359 A1* 5/2020 Nakagawa ..... F02M 69/34
2020/0232422 A1* 7/2020 Asanuma ..... F02M 25/089

FOREIGN PATENT DOCUMENTS

CN 106489022 A 3/2017
CN 106715882 A 5/2017
CN 106812620 A 6/2017
CN 107923338 A 4/2018
DE 10 2010 019 373 A1 11/2011
EP 2333290 A1 6/2011
JP 06101534 A * 4/1994
WO WO 2010/022431 A1 3/2010
WO WO 2012/049219 A1 4/2012

* cited by examiner

METHOD FOR CONTROLLING A CONTROL VALVE

CROSS-REFERENCE TO RELATED APPLICATIONS

This application claims priority from German Patent Application No. 10 2018 112 731.6, filed May 28, 2018, which is hereby incorporated by reference.

FIELD OF THE INVENTION

The present invention relates to a method for controlling a control valve, in particular a control valve of an evaporative emission control system, preferably the evaporative emission control system of a motor vehicle.

BACKGROUND OF THE INVENTION

Control valves in evaporative emission control systems control a volume flow from a filter (an adsorbent) of a tank to an intake manifold (respectively, a passage between the filter and at least one combustion chamber) of a combustion engine.

Normally, the filter is an activated-carbon filter that absorbs the components of the fluid stored in the tank (for example, a fuel) that are outgassed from the tank. The activated-carbon filter is fluidically connectable to the intake manifold of the combustion engine via the control valve, so that the fluid absorbed or temporarily stored in the filter can be supplied to the combustion chamber in a controlled manner.

To calculate the fuel quantity to be injected, it is necessary to know the quantity of fuel supplied through the evaporative emission control system.

Lambda probes, for example, are used in known methods heretofore to determine the quantity supplied via the evaporative emission control system. To that end, the control valve of the evaporative emission control system is opened slowly, and the deviation from a setpoint value for lambda (fuel-air ratio, determined by an exhaust-gas sensor system) is monitored. It is thereby assumed that this deviation results solely from the supplying of fuel from the evaporative emission control system. For this, a signal is analyzed downstream of the combustion chamber; however, this means that a deviation from the setpoint value for lambda must first occur before a control can take place. The result is an increase in untreated emissions.

In addition, all mixture deviations are attributed to the fuel supplied from the evaporative emission control system. In the case of an inaccurate mixture precontrol (and a deviation from a setpoint value for the mixture), the computed amount of fuel does not correspond to the actual amount of fuel. As a result, the tank ventilation must be controlled very carefully, respectively be heavily restricted, so as not to overly impact the running smoothness and the untreated emissions of the combustion engine.

The World Patent Application WO 2012/049219 A1 describes a pump for delivering purge air, allowing the fuel to be selectively drawn from the filter and supplied to the combustion engine.

SUMMARY OF THE INVENTION

It is, therefore, an object of the present invention to at least partially solve the problems described with reference to the related art. In particular, a method is to be provided to control a control valve, which will make it possible to more accurately control the amount of fuel fed to the combustion chamber.

A method having the features set forth in claim 1 contributes to the achievement of these objectives. Advantageous embodiments constitute the subject matter of the dependent claims. The features individually specified in the claims may be combined with one another in a technologically useful way and be supplemented by illustrative subject matter from the Specification and/or by the details pertaining to the figures; further variants of the present invention being presented.

A method is provided for controlling a control valve, the control valve controlling a volume flow of a fluid along a line (first line, second line; thus, through the line), in particular from a filter of a tank to an intake manifold of a combustion engine. The method at least includes the following steps:

a) performing a closing operation of the control valve; and b) measuring a pressure profile upstream of the control valve;

c) determining a density (mass per volume, thus, [kilogram/cubic meter]) of the fluid.

The control valve controls, in particular a volume flow along a passage between the filter and combustion engine. In some instances, the passage is connected to the intake manifold via a feed point.

In particular, steps a) through c) are performed in the described sequence. In particular, steps a) and b) are at least performed parallel in time. Step c) is carried out, in particular in consideration of the pressure profile, thus, preferably subsequently to step b).

In particular, in step b), at least a minimum and a maximum of the pressure profile are recorded. In particular, a minimum of the pressure profile is recorded that is present in the pressure profile immediately before the control valve is closed. In particular, a maximum of the pressure profile is recorded that is present in the pressure profile immediately after the control valve is closed.

Closing the control valve entails, in particular that no volume flow is able to stream over the same in the closed state thereof.

The pressure profile is measured, in particular by a continuous or intermittent sensory recording of a pressure state. Specific sensor measurement values may be cumulated. Individual values of the pressure measurement may be averaged and/or stored. The pressure profile may be characterized or analyzed on the basis of the following pressure parameters: maximum values, minimum values, deviations from measured or definable measured or threshold values, rate of change.

The density of the fluid may be determined mathematically on the basis of measured pressure states or pressure parameters derived therefrom; if indicated, taking one of the aforementioned pressure parameters into account. The density of the fluid may be determined, in particular by evaluating (at least) the minimum and maximum of the pressure profile.

In particular, in a further step i), the volume flow of the fluid streaming over the at least partially opened control valve may be measured (for example, recorded metrologically via a hot-film sensor or the like). In particular, the volume flow may be measured immediately before the closing operation is introduced in accordance with step a). The volume flow may especially be measured in the process of opening the control valve that follows the closing operation in accordance with step a). In particular, the volume flow is recorded metrologically.

Knowing the density and volume flow makes it possible to determine at least a first amount of a first component of the fluid and a second amount of a second component of the fluid.

In particular, the first component is air, and the second component a fuel. The fuel is present at least partially, in particular completely in gaseous form. In some instances, the fuel may be present as a liquid.

A temperature of the fluid may be measured in another step ii). Knowing the temperature makes it possible to determine the density of the fluid (with greater accuracy). In particular, the temperature is measured together with the pressure, for example, by a combination sensor (pressure/temperature sensor).

The control valve is operated at at least one frequency, in particular respectively opens and closes in the frequency. In particular, the control valve may thus provide a pulsed volume flow of the fluid.

The method, in particular at least steps a) through c), possibly additionally at least one of steps i) and ii) (or in each case both) is implemented at least in response to two, three, four or more successive closing operations, in particular in response to every closing operation.

In particular, the density ascertained in accordance with step c) may be verified by repeatedly implementing the method. In some instances, it may be possible to average the measured values for the density.

In particular, the frequency is between 5 and 50 Hertz, preferably between 5 and 20 Hertz.

The control valve is especially controlled by a (PWM) signal (pulse width modulation); at a specific duty cycle, the control valve being successively opened, in particular. Notably, a volume flow streaming over the control valve may be controlled by the duty cycle.

An addition of fuel to the combustion engine is controlled, in particular as a function of the specific density of the fluid.

The amount of fuel in the fluid may be measured as a function of the determination of the density, so that the controlled opening of the control valve makes possible a more accurate addition of a definable fuel quantity.

In particular, the pressure sensor is located between the filter and the control valve.

In particular, the control valve is configured to allow a pulsed volume flow to be directed thereover toward the suction line. In particular, the control valve is controlled by a PWM signal.

A flow of the fluid forms during the open phase of the control valve. If the control valve then closes, the volume flow of the fluid is abruptly interrupted. This leads to a measurable pressure rise upstream of the control valve. The profile of the pressure rise or of the pressure variation is, in particular a function of the velocity of the volume flow during the open phase and of the density of the fluid.

The density of the fluid may be determined using the pressure sensor, respectively while also determining the temperature. The amounts of air and fuel may be determined from the generally known single density values (density of the fuel being used and density of the air, possibly determined as a function of temperature) and the (total) density of the fluid.

The described method makes it possible to determine the amount of the fuel or the amount of the fuel coming from the filter, this amount already being measured upstream of the combustion chamber. It may thus be possible to control fuel being added to the combustion engine already before the fuel is combusted.

In particular, the density may be determined at the frequency mentioned, so that even abrupt and/or sudden changes in the composition of the fluid may be determined, and fuel may be added in a controlled manner, taking these changes into consideration.

An accuracy with which the amount of fuel in the fluid is determined is also a function of a quality of the mixture precontrol.

It is thus possible to control the addition of fuel before the fuel is combusted, making it possible for untreated emissions to be lowered.

It is also possible to rapidly control the tank ventilation (respectively, a rapid opening of the control valve), making it possible to increase the purge air volume. The increase in the purge air volume makes it possible to better remove the fuel stored in the filter therefrom.

Also provided is a motor vehicle, at least having a combustion engine having at least a combustion chamber; a tank, which is provided for a fuel that is reactable in the combustion engine, having a filter; an intake manifold, via which at least air and the fuel may be supplied to the combustion chamber; a control valve, which controls a volume flow including at least the fuel from the filter to the intake manifold (along the line, especially the first line and the second line), or controls the same in accordance with the underlying control circuit; as well as a pressure sensor for measuring a pressure profile upstream of the control valve. For opening and closing, the control valve may be controlled by a control unit. The control unit is adapted or suitably designed for implementing the already described method. Thus, the control unit is able to implement the described method or execute it during operation of the motor vehicle.

In particular, the method may also be employed for combustion engines that are not used in motor vehicles.

The method may also be employed when amounts of the fluid are to be generally determined in gas-carrying lines. To that end, there is no need to feed the fluid to any combustion engine.

The method may also be realized by a computer or a processor of a control unit.

Accordingly, a data processing system may also be provided, which includes a processor that is adapted/configured for executing the method or some of the steps of the method provided.

A computer-readable storage medium may be provided that includes commands that cause it to implement the method or at least some of the steps of the proposed method in response to the execution by a computer/processor.

The explanations regarding the method may be applied, in particular to the motor vehicle or the computer-implemented method and vice versa.

The density of the fluid including air and fuel determined in accordance with the present invention may also be used for (directly or indirectly) controlling an addition of a fuel quantity to a combustion engine. Other, particularly advantageous uses and applications of the measured fuel-air mixture for controlling the combustion processes, particularly for motor vehicles, are derived from the further explanations concerning the method indicated here.

For the sake of completeness, it should be noted in this regard that the numerals used here ("first," "second," . . . ) are primarily used to (merely) distinguish among a plurality of substantially identical objects, quantities or processes, thus, in particular, do not specify a mutual dependency and/or mutual sequence thereof. Should a dependency and/or sequence be necessary, this is indicated here explicitly, or it becomes apparent to one skilled in the art in studying the specifically described embodiment.

BRIEF DESCRIPTION OF THE DRAWINGS

The present invention, as well as the technical field are explained in greater detail in the following with reference to the enclosed figures. It should be noted that the present invention is not to be limited by the cited exemplary embodiments. In particular, unless explicitly described otherwise, it is also possible to extract partial aspects of the subject matter explained in the figures and to combine them with other elements and realizations from the present description. It should be noted, in particular that the figures and, in particular the illustrated relative sizes are only schematic.

DETAILED DESCRIPTION OF THE INVENTION

Figure 1:
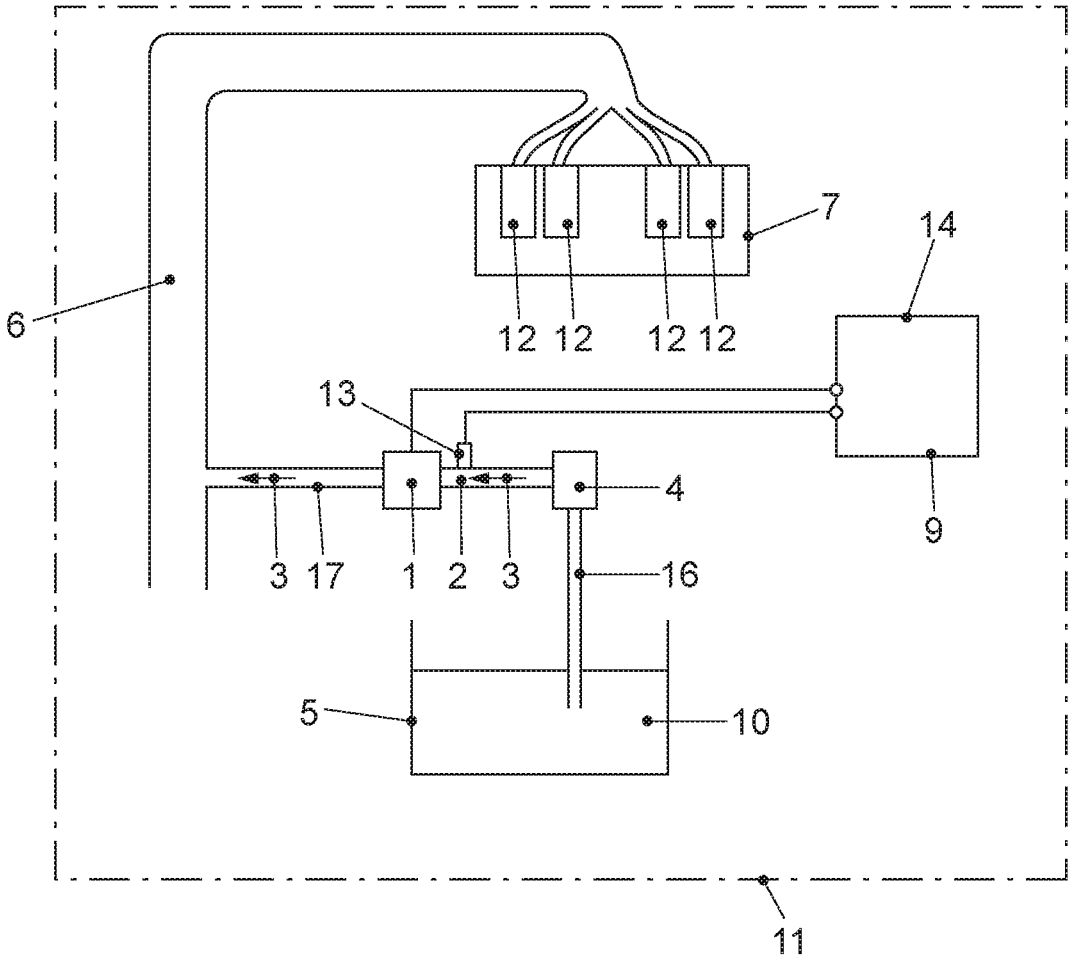
FIG. 1 shows a motor vehicle.

FIG. 1 shows a motor vehicle 11. Motor vehicle 11 includes a combustion engine 7 having a plurality of combustion chambers 12, a tank 5 which is provided for a fuel 10 that is reactable in combustion engine 7 and which has a filter 4, an intake manifold 6, via which at least air and fuel 10 may be supplied to combustion chamber 12, as well as a control valve 1 that controls a volume flow 2 of fluid 3 that includes fuel 10 from filter 4 via lines 16, 17 to intake manifold 6. A control unit 14 is able to control the opening and closing of control valve 1. Control unit 14 is adapted or suitably designed for implementing the method.

Directly upstream of control valve 1, motor vehicle 11 also includes a pressure sensor 13 via which pressure 18 or pressure profile 9 is measurable upstream of control valve 1.

Fuel 10 is stored in a tank 5, it being possible for fuel vapors to reach filter 4 via first line 16. Fuel 10 temporarily stored in filter 4 is transferred via control valve 1 and via second line 17 to intake manifold 6.

Figure 2:
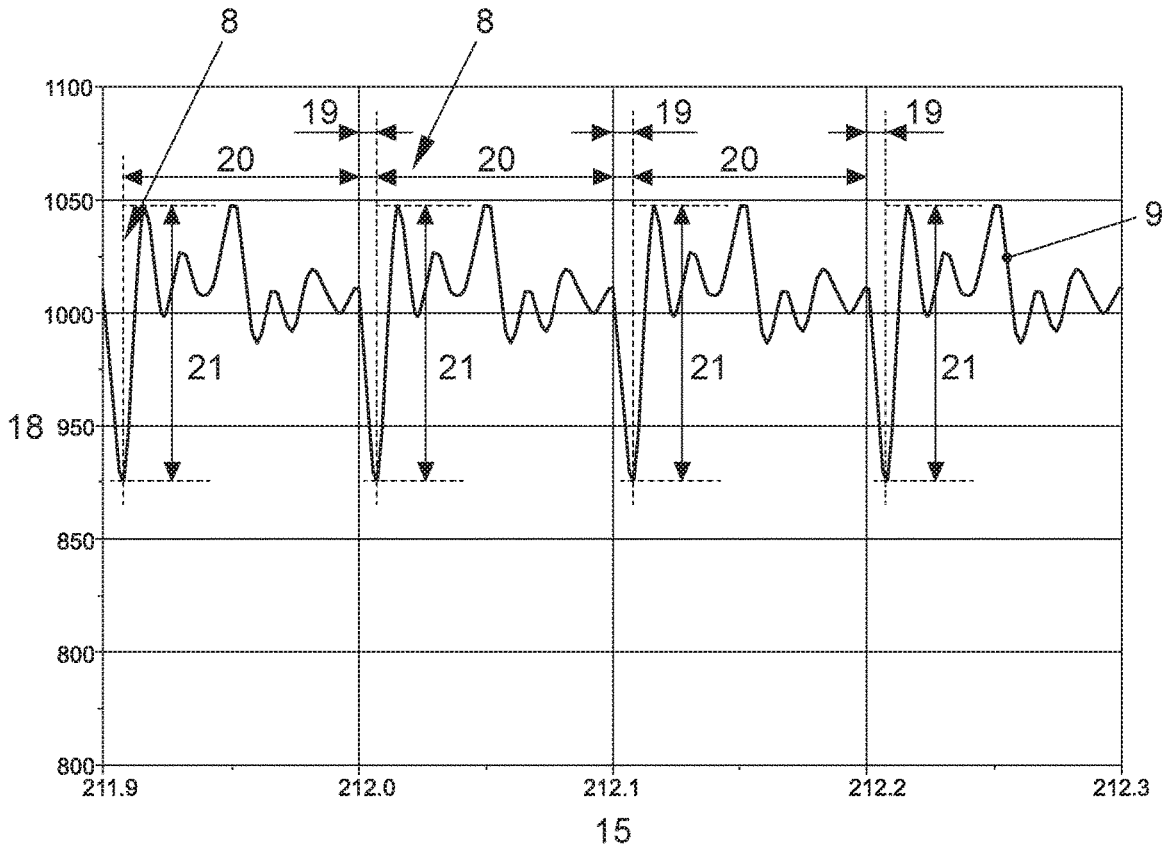
FIG. 2: shows a variant of the method.

FIG. 2 shows a variant of the method in a diagram. Pressure 18, which is measured by pressure sensor 13 (directly) upstream of control valve 1, is plotted on the vertical axis. Time 15 is plotted on the horizontal axis.

A closing operation 8 of control valve 1 is performed in accordance with step a). Pressure profile 9 is measured upstream of control valve 1 in accordance with step b). A density of fluid 3 is determined in accordance with step c).

Control valve 1 is operated at one frequency, and opens and closes in the frequency (here, the frequency is 10 Hertz). The method is performed here for four successive closing operations 8.

During open phase 19 of control valve 1, a flow of fluid 3 forms. If control valve 1 then closes (closing operation 8, transition to closed phase 20), volume flow 2 of fluid 3 is abruptly interrupted. This leads to a measurable pressure rise upstream of control valve 1. The profile of the pressure rise (thus, pressure profile 9) or the pressure variation (respectively, measured pressure difference 21) is a function of the velocity of volume flow 2 during open phase 19 and of the density of fluid 3. The illustrated undulation of pressure profile 9 represents the pressure variation upstream of control valve 1 that is caused by closing operation 8.

The density of fluid 3 may be determined by pressure sensor 13, respectively with the additional determination of the temperature. The amounts of air and fuel 10 may be determined from the generally known single density values (density of fuel 10 being used and density of the air, possibly determined as a function of temperature) and the measured (total) density of fluid 3.

The described method makes it possible to determine the amount of fuel 10 or the amount of fuel 10 coming from filter 4, this amount already being measured upstream of combustion chamber 12. Consequently, the addition of fuel to combustion engine 7 may be controlled already before fuel 10 is combusted.

REFERENCE NUMERAL LIST

1 control valve
2 volume flow
3 fluid
4 filter
5 tank
6 intake manifold
7 combustion engine
8 closing operation
9 pressure profile
10 fuel
11 motor vehicle
12 combustion chamber
13 pressure sensor
14 control unit
15 time
16 first line
17 second line
18 pressure
19 open phase
20 closed phase
21 pressure difference

The invention claimed is:

1. A method for controlling a control valve, the control valve controlling a volume flow of a fluid along a line, the method comprising at least the following steps performed in the following order:

a) measuring at least a minimum of a pressure profile upstream of the control valve while the control valve is at least partially open, the measuring occurring immediately prior to the control valve being closed;

b) performing a closing operation on the control valve, while the control valve is at least partially open, to yield a closed control valve;

c) measuring at least a maximum of a pressure profile upstream of the closed control valve immediately after the control valve is closed; and d) determining a density of the fluid based on both the minimum of the pressure profile upstream of the control valve while the control valve is at least partially open and the maximum of the pressure profile upstream of the closed control valve.

2. The method as recited in claim 1, wherein measuring the minimum of the pressure profile includes measuring the volume flow of the fluid streaming over the at least partially open control valve.

3. The method as recited in claim 2, further comprising, based on the density and the volume flow of the fluid, determining at least a first amount of a first component of the fluid and a second amount of a second component of the fluid.

4. The method as recited in claim 3, wherein the first component is air, and the second component is a fuel.

5. The method as recited in claim 1, further comprising measuring a temperature of the fluid, wherein the determination of the density of the fluid is additionally based on the temperature.

6. The method as recited in claim 1, wherein the control valve opening and closing occurs at a definable frequency, wherein steps a) through d) are carried out during at least two successive closing operations.

7. The method as recited in claim 6, wherein the frequency is between 5 and 50 Hertz.

8. The method as recited in claim 1, wherein the control valve controls the volume flow of the fluid from a filter of a tank to an intake manifold of a combustion engine, and an addition of fuel to the combustion engine is controlled as a function of the density of the fluid.

9. The method as recited in claim 1, further comprising calculating an amount of fuel to be injected into a combustion engine based on a density of air, a density of the fuel, and the determined density of the fluid.

10. A motor vehicle comprising:

a combustion engine having at least a combustion chamber;

a tank, which is provided for a fuel that is reactable in the combustion engine and which has a filter;

an intake manifold, via which at least air and the fuel may be supplied to the combustion chamber;

a control valve that controls a volume flow of a fluid along a line, wherein the fluid includes the fuel from the filter to the intake manifold;

a pressure sensor for measuring at least a minimum and a maximum of a pressure profile upstream of the control valve; and a processor configured to perform the following in the following order:

measure at least a minimum of the pressure profile upstream of the control valve while the control valve is at least partially open, the measure occurring immediately prior to the control valve being closed, a closing operation on the control valve, while the control valve is at least partially open, to yield a closed control valve, measure at least a maximum of the pressure profile upstream of the closed control valve immediately after the control valve is closed, and determine a density of the fluid based on both the minimum of the pressure profile upstream of the control valve while the control valve is at least partially open and the maximum of the pressure profile upstream of the closed control valve.

* * * * *